US005094305A

United States Patent [19]

Wenzel

[11] Patent Number: 5,094,305

[45] Date of Patent: Mar. 10, 1992

[54] ORIENTATABLE ADJUSTABLE BENT SUB

[75] Inventor: Kenneth H. Wenzel, Edmonton, Canada

[73] Assignee: Kenneth H. Wenzel Oilfied Consulting Inc., Alberta, Canada

[21] Appl. No.: 626,694

[22] Filed: Dec. 13, 1990

[30] Foreign Application Priority Data

Jan. 23, 1990 [CA] Canada ..... 2008417

[51] Int. Cl.[5] ..... E21B 7/08

[52] U.S. Cl. ..... 175/74; 175/75; 175/101; 175/107

[58] Field of Search ..... 175/74, 75, 101, 107

[56] References Cited

U.S. PATENT DOCUMENTS

| | | | |
|---|---|---|---|
| 1,850,403 | 3/1932 | Lee . | |
| 3,586,116 | 6/1971 | Tirapolsky | 175/74 |
| 3,717,208 | 2/1973 | Anderson | 175/74 |
| 4,077,657 | 3/1978 | Trzeciak | 285/184 |
| 4,220,214 | 9/1980 | Benoit | 175/61 |
| 4,258,800 | 3/1981 | Hipp | 175/61 |
| 4,492,276 | 1/1985 | Kamp | 175/107 X |
| 4,522,272 | 6/1985 | Beimgraben | 175/107 X |
| 4,596,294 | 6/1986 | Russell | 175/74 |
| 4,694,914 | 9/1987 | Obrecht | 175/74 X |
| 4,745,982 | 5/1988 | Wenzel | 175/74 |
| 4,811,798 | 3/1989 | Falgout, Sr. et al. | 175/73 |
| 4,813,497 | 3/1989 | Wenzel | 175/74 |
| 4,843,945 | 7/1989 | Dinsdale | 81/57.34 |
| 4,884,643 | 12/1989 | Wawrzynowski et al. | 175/75 X |
| 4,899,833 | 2/1990 | Warren et al. | 175/45 |
| 4,913,466 | 4/1990 | Becker | 285/24 |

*Primary Examiner*—Ramon S. Britts
*Assistant Examiner*—Roger J. Schoeppel
*Attorney, Agent, or Firm*—Beveridge, DeGrandi & Weilacher

[57] ABSTRACT

An orientatable adjustable bent sub having a tubular member in the form of a adjustment sleeve, with a first and offset to a primary axis, telescopically receives the first end of the tubular member. By rotation of the adjustment sleeve the offset portion of the adjustment sleeve is adjusted in relation to the offset portion of the tubular member to produce a bend of desired magnitude. The adjustment sleeve is axially moveable between an engaged position and a disengaged position. In the disengaged position the adjustment sleeve is rotatable in relation to the tubular member permitting an adjustment to be made. An orientation sleeve telescopically receives the second end of the tubular member. By rotation of the tubular member within the orientation sleeve the bend created by the positioning of the offset portion of the adjustment sleeve in relation to the offset portion of the tubular member is orientated in a desired direction. The orientation sleeve is axially moveable between an engaged position and a disengaged position. In the disengaged position the orientation sleeve is rotatable in relation to the tubular member permitting an adjustment to be made.

8 Claims, 4 Drawing Sheets

ORIENTATABLE ADJUSTABLE BENT SUB

The present invention relates to an adjustable bent sub.

BACKGROUND OF THE INVENTION

In the art of oilfield drilling technology "directional drilling" is becoming increasingly prominent. In directional drilling the angle of the borehole is altered during the drilling operation from vertical toward horizontal. Initially directional drilling was developed in order to explore for oil under natural barriers such as lakes. However, it has been determined that if the borehole passes along rather than merely vertically traverses a permeable oil bearing formation a dramatically increased flow rate can be obtained. When directional drilling was in its infancy, the "bent subs" used were merely sections of drill string machined to have a preselected angular offset. This required a plurality of bent subs to be kept on site as a range of angular offsets were required. As the art advanced bent subs were developed which could be adjusted to a variety of angular offsets eliminating the need for a plurality of bent subs. An example of such an adjustable bent sub developed by the Applicant is Canadian Patent 1,243,663.

At the present time persons skilled in the art of directional drilling when high angle or horizontal holes are drilled to place two bent subs in the drilling motor assembly. The reason two are used is to permit an increased angle to be obtained. To go from a vertical to a horizontal hole it is often required to "build angle" very quickly. It is generally viewed as desirable to place the bent subs as close to the drill bit as possible. One bent sub is generally positioned between the downhole drilling motor and the bearing assembly, and the other is generally placed above the downhole drilling motor. Whenever two bent subs are used an additional problem is created. The bent subs must be orientated with respect to each other in order that the angular offset created is cumulative. Initially, the orientation of the bent subs was achieved through the use of an "orientation sub", which was well known in the art. An orientation sub, as its name implies, has one component which can rotate in relation to a mating component in order to orientate the drill string. As previously stated it is desirable to have the bent subs as close to the drill bit as possible. The use of an orientation sub added to the length of the drilling motor assembly; for this reason, the use of orientation subs in this application has been abandoned in favor of a plurality of "shims" between the shoulders of the threaded connection at the motor and bent sub. The obvious advantage of using shims is that they do not add appreciably to the length of the drilling motor assembly. However, there are a number of obvious disadvantages in orientating the bent subs using shims; such as the time required for adjustment.

SUMMARY OF THE INVENTION

What is required is an apparatus for orientating an adjustable bent sub in a drill string which will not add to the length of the drilling motor assembly.

According to the present invention there is provided an orientatable adjustable bent sub, which is comprised of a tubular member having a first end, a second end, and an exterior surface. The tubular member has a primary axis. Means are provided to offset the first end of the tubular member from the primary axis. An adjustment sleeve is provided having a first end and a second end. The second end of the adjustment sleeve telescopically receives the first end of the tubular member. The adjustment sleeve has a primary axis. Means are provided to offset the first end of the adjustment sleeve from the primary axis. By rotation of the adjustment sleeve the offset portion of the adjustment sleeve is adjusted in relation to the offset portion of the tubular member to produce a bend of desired magnitude. Means are provided to stop rotation of the adjustment sleeve in relation to the tubular member. The adjustment sleeve is axially moveable between an engaged position engaged with the rotational stop means and a disengaged position disengaged from the rotational stop means. Means is provided to lock the adjustment sleeve in the engaged position. An orientation sleeve is provided having a first end and a second end. The first end of the orientation sleeve telescopically receives the second end of the tubular member. The second end of the orientation sleeve is adapted for connection to a drill string. By rotation of the tubular member within the orientation sleeve the bend created by the positioning of the offset portion of the adjustment sleeve in relation to the offset portion of the tubular member is orientated in a desired direction. Means is provided to stop rotation of the orientation sleeve in relation to the tubular member. The orientation sleeve is axially moveable between an engaged position engaged with the rotational stop means and a disengaged position disengaged from the rotational stop means. Means is provided to lock the orientation sleeve in the engaged position.

The invention, as described, permits a person skilled in the art to create a "bend" or "angular offset" as required in directional drilling and to orientate the offset as desired.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 2:
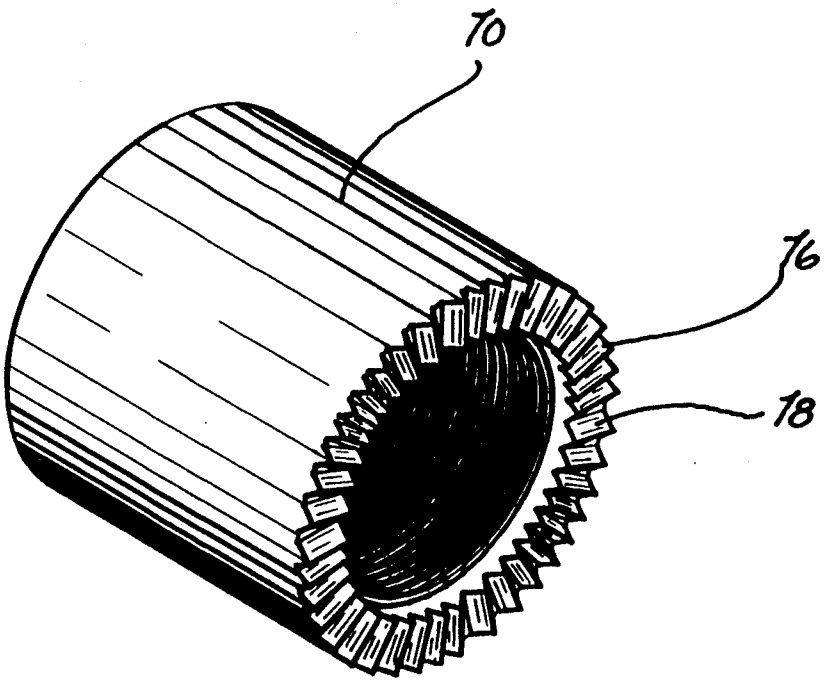
FIG. 2 is a perspective view of a component of the adjustable bent sub illustrated in FIG. 1.
Figure 3:
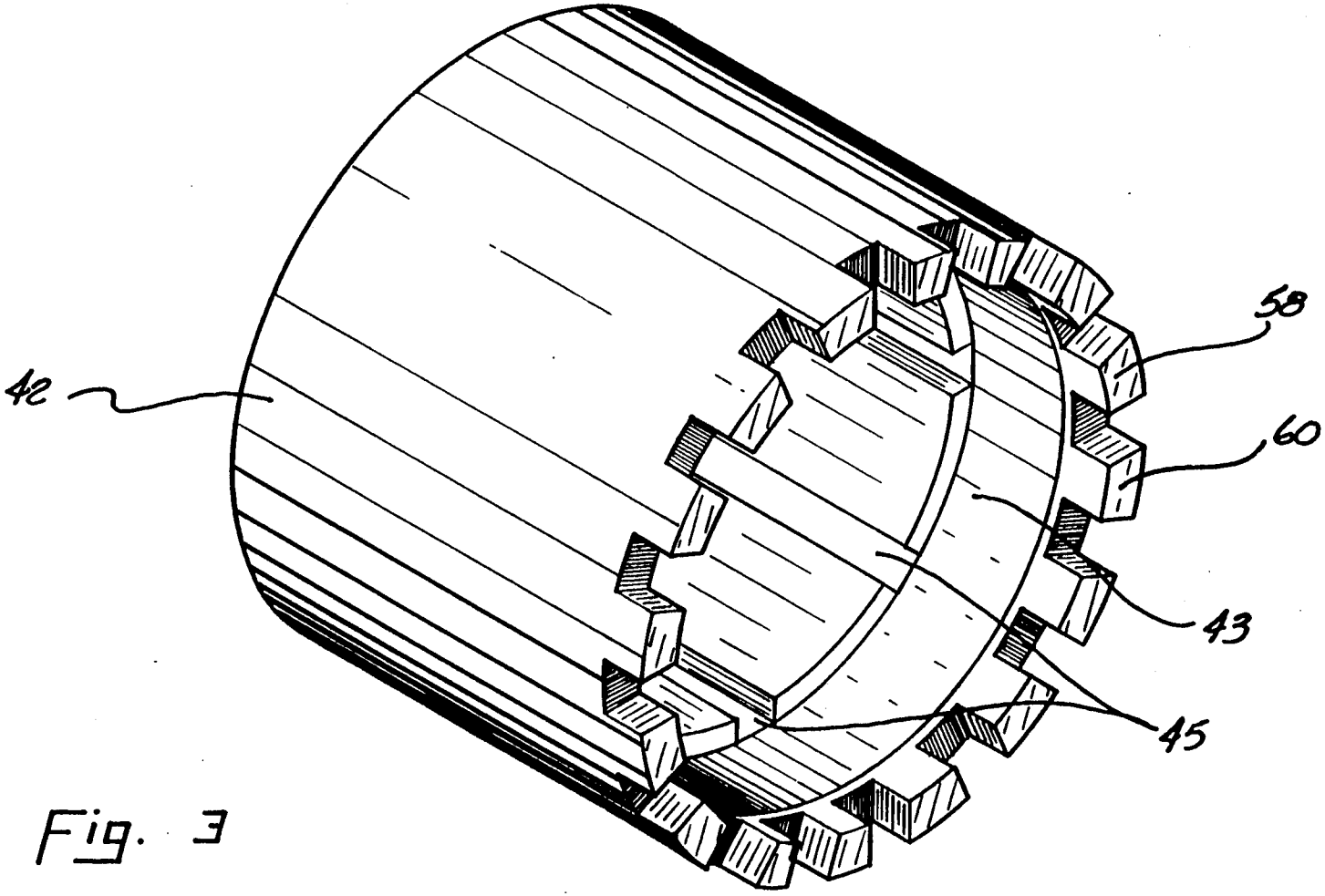
FIG. 3 is a perspective view of another component of the adjustable bent sub illustrated in FIG. 1.

The preferred embodiment will now be described with reference to FIGS. 1 through 3. The preferred embodiment, generally designated by reference numeral 10, is an orientatable adjustable bent sub. The primary components of orientatable adjustable bent sub 10 are a tubular member 12, an adjustment sleeve 14 and an orientation sleeve 16. An alternate preferred embodiment will also be described with reference to FIG. 4 to illustrate alternate ways in which the above described components can be configured. It must be appreciated that the invention goes beyond the embodiments illustrated.

Tubular member 12 has a first end 18, a second end 20, and an exterior surface 22. Shoulders 24 and 26, respectively, are formed on exterior surface 22. Exterior surface 22 also has annular threaded zones 28, 30, 32, and 34 and a plurality of longitudinal keyways 36.

Tubular member 12 has a primary axis 38, which can be considered its symmetrical rotational axis.

Adjustment sleeve 14 is divided into two portions; a rotatable portion 40 and an axially movable portion 42. Adjustment sleeve 14 telescopically receives first end 18 of tubular member 12. Adjustment sleeve 14 has a primary axis which in FIG. 1 happens to be coincident with primary axis 38 of tubular member 12. Rotatable portion 40 has an internal bore 46, first end 52 and a second end 48 with axially extending teeth 50. Internal bore 46 has internal shoulders 47. O ring seals 49 are positioned in internal bore 46 at first end 52. Rotatable portion 40 has an external surface 54 which has threads 56 adjacent first end 52 whereby rotatable portion 40 is coupled to a tubular component of a drill string (not shown). Referring to FIG. 3, axially movable portion 42 has a first end 58 with axially extending teeth 60 for matingly engaging teeth 50 on rotatable portion 40. Axially movable portion 42 is axially movable along tubular member 12 between an engaged position wherein teeth 60 of axially movable portion 42 are engaged with teeth 50 of rotatable portion 40 and a disengaged position wherein axially movable portion 42 is disengaged from rotatable portion 40 such that rotatable portion 40 is freely rotatable. The engagement between rotatable portion 40 and axially movable portion 42 is sealed by a sealing ring 51 which has a plurality of O ring seals 53. Referring to FIG. 3, axially movable portion 42 has an interior surface 43 with longitudinal keyways 45. An adjustment lock nut 44 is axially movable along tubular member 12. Adjustment lock nut 44 has an internal surface 62 with threads 64. Adjustment lock nut 44 engages threaded zone 30 on exterior surface 22 of tubular member 12 to secure axially movable portion 42 in the engaged position. A first end nut 66 is non-rotatably secured to threaded zone 28 at first end 18 of tubular member 12 thereby preventing separation of tubular member 12 and adjustment sleeve 14.

The required offset from the primary axis 38 between the adjustment sleeve 14 and the tubular member 12 can be created in a number of ways. In the preferred embodiment tubular member 12 has an offset created at the time of manufacture by machining first end 18 with a 1 degree deviation from primary axis 38. Although a 1 degree deviation is used one skilled in the art will recognize the operable range of offsets. Rotatable portion 40 has a corresponding offset. In the preferred embodiment this has been created by machining threads 56 at an angle to create a 1 degree deviation. The offset could similarly be created by machining internal bore 46 with a 1 degree deviation between second end 48 and first end 52. The angular offset between adjustment sleeve 14 and tubular member 12 is adjustable upon rotation of rotatable portion 40 in relation to tubular member 12. Once an adjustment has been made sleeve 14 is non-rotatably coupled to tubular member 12 by placing axially movable portion 42 of adjustment sleeve 14 in an engaged position. In the engaged position keyways 45 formed in interior surface 43 of axially movable portion 42 are aligned with keyways 36 formed in exterior surface 22 of tubular member 12. Keys 68 extend between aligned keyways 45 and 36 to non-rotatably couple axially movable portion 42 to tubular member 12. The mating of teeth 60 of axially movable portion 42 and teeth 50 of rotatable portion 40, serve to non-rotatably couple all of adjustment sleeve 14 to tubular member 12.

Orientation sleeve 16 has a first end 75 and a second end 80. First end 75 of orientation sleeve 16 telescopically receives second end 20 of tubular member 12. Second end nut 70 is non-rotatably secured to threaded zone 34 at second end 20 of tubular member 12 to prevent the separation of orientation sleeve 16 and tubular member 12. As illustrated in FIG. 2, an end 76 of second end nut 70 has axially extending teeth 78. Second end 80 of orientation sleeve 16 has axially extending teeth 82 for matingly engaging teeth 78 on second end nut 70. Orientation sleeve 16 is axially movable along tubular member 12 between an engaged position wherein teeth 82 are engaged with teeth 78 on second end nut 70 and a disengaged position wherein orientation sleeve 16 is disengaged from second end nut 70. When in the disengaged position orientation sleeve 16 is freely rotatable and when in the engaged position the engagement of teeth 82 and teeth 78 serves as a rotational stop. Orientation sleeve 16 has an internal bore 77 with internal shoulders 79. O ring seals 81 are positioned in internal bore 77 at second end 80 and first end 75. Orientation sleeve 16 has an external surface 86 with threads 88 adjacent second end 80 whereby orientation sleeve 16 is coupled to a tubular component of a drill string (not shown). By disengaging orientation sleeve 16 and rotating tubular member 12, bend created by the positioning of the offset portion of adjustment sleeve 14 in relation to the offset portion of tubular member may be orientated in any direction that is desired. An orientation lock nut 74 is axially movable along tubular member 12. Orientation lock nut 74 has an interior surface 90 with threads 92 whereby orientation lock nut 74 engages threaded zone 32 on exterior surface 22 of tubular member 12 to secure orientation sleeve 16 in the engaged position. To prevent drilling mud from adversely effecting threaded zones 30 and 32 adjustment lock nut 44 and orientation lock nut 74 have peripheral wiper seals 94.

The use and operation of orientatable adjustable bent sub 10 will now be described with reference to FIGS. 1 through 3. The description will start from a position with all the components of orientatable adjustable bent sub 10 assembled as illustrated in FIG. 1. Orientatable adjustable bent sub 10 is first secured in the drill string by securing a tubular component (not shown) to threads 56 on external surface 54 of rotatable portion 40 of adjustment sleeve 14, and a tubular component (not shown) to threads 88 on external surface 86 of orientation sleeve 16. Adjustment sleeve 14 is then adjusted to the desired angular offset. The adjustment is made by loosening threads 64 of adjustment lock nut 44 on threaded zone 30 on exterior surface 22 of tubular member 12. Adjustment lock nut 44 is then rotated in order to move it axially away from adjustment axially movable portion 42. Axially movable portion 42 can then be moved axially away from rotatable portion 40. The movement of axially movable portion 42 disengages teeth 60 on axially movable portion 42 from teeth 50 on rotatable portion 40. As axially movable portion 42 is moved, keys 68 remain in position in keyways 36 on exterior surface 22 of tubular member 12. However, the relative longitudinal position of keys 68 with respect to keyways 45 in interior surface 43 of axially movable portion 42 is altered. Once rotatable portion 40 is disengaged from axially movable portion 42, rotatable portion 40 becomes freely rotatable. The extent of axial movement of rotatable portion 40 toward first end 18 of tubular member 12 is limited by first end nut 66 and toward second end 20 of tubular member 12 by shoulders 24 of tubular member 12 which engage shoulders 47 of rotatable portion 40. Due to the 1 degree deviation created at the time of machining in first end 18 of tubular member 12 and the like deviation in threads 56 of rotatable portion 40, rotating rotatable portion 40 serves to effect the extent of the offset of orientatable adjustable bent sub 10. The 1 degree deviations can be made in whole or in part cumulative creating an offset of up to 2 degrees, or the deviations can be made offsetting so the cumulative total of the two 1 degree deviations corresponds with primary axis 38. For ease of adjustment in the field markings (not shown) are usually placed on teeth 50 and teeth 60 of adjustment sleeve 14 indicating the selections of angular offset. Once an angular offset has been selected, axially movable portion 42 is moved axially until teeth 60 on axially movable portion 42 are in interlocking engagement with teeth 50 on rotatable portion 40. Threads 64 of adjustment lock nut 44 are then tightened on threaded zone 30 maintaining teeth 50 of axially movable portion 42 and teeth 60 of rotatable portion 40 in an engaged position. Keys 68 extending between aligned keyways 36 on exterior surface 22 of tubular member 12 and keyways 45 on interior surface 43 of axially movable portion 42, serve to non-rotatably couple tubular member 12 and adjustment sleeve 14.

In a typical drilling situation where two bent subs are used, the selected bend on orientatable adjustable bent sub 10 must be orientated to correspond with the bend on the other of the bent subs (not shown). This is done by loosening threads 92 on interior surface 90 of orientation lock nut 74 from threaded zone 32 on exterior surface 22 of tubular member 12. Orientation lock nut 74 is then moved axially away from orientation sleeve 16. Orientation sleeve 16 can then be moved axially away from second end nut 70. The movement of orientation sleeve 16 disengages teeth 82 at second end 80 of orientation sleeve 16 from teeth 78 on end 76 of second end nut 70. Tubular member 12 can then freely rotate in relation to orientation sleeve 16, permitting the bend in orientatable adjustable bent sub 10 to be aligned with the bend on the other of the adjustable bent subs (not shown). The extent of axial movement of orientation sleeve 16 toward second end 20 of tubular member 12 is limited by second end nut 70 and toward first end 18 of tubular member 12 by shoulders 26 of tubular member 12 which engage shoulders 79 of orientation sleeve 16. Once the bent subs are aligned orientation sleeve 16 is moved axially on tubular member 12 until teeth 82 of orientation sleeve 16 are interlocked with teeth 78 of second end nut 70. Orientation lock nut 74 is then tightened against orientation sleeve 16 and threads 92 on interior surface 90 of orientation lock nut 74 are engaged with threaded zone 32 on exterior surface 22 of tubular member 12; thereby maintaining non-rotatable engagement between orientation sleeve 16 and tubular member 12.

Figure 1:
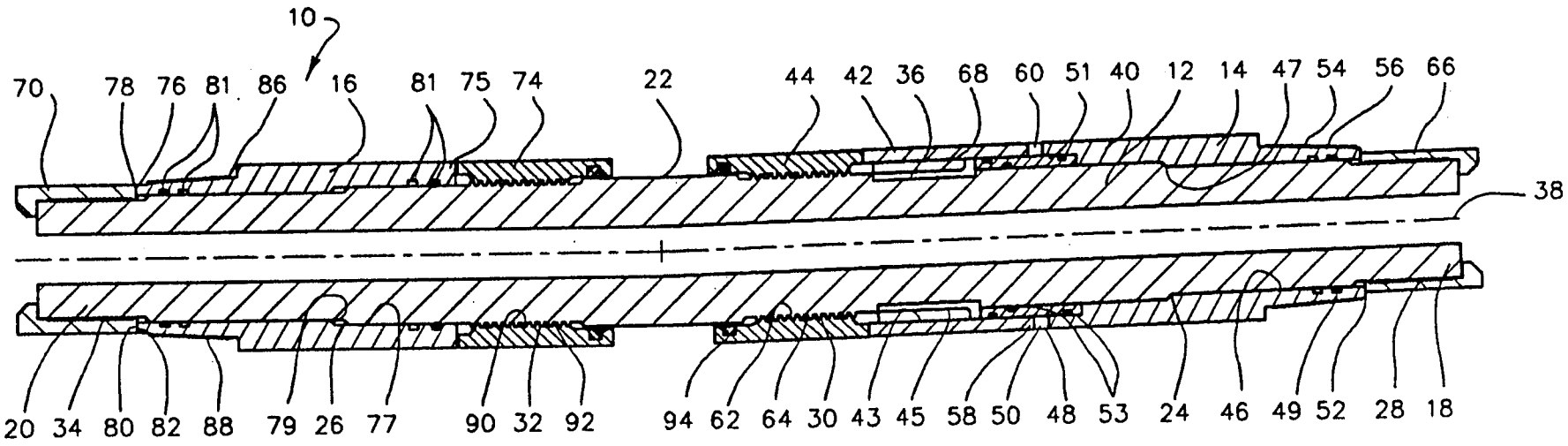
FIG. 1 is longitudinal section view of a preferred embodiment of the invention.
Figure 4:
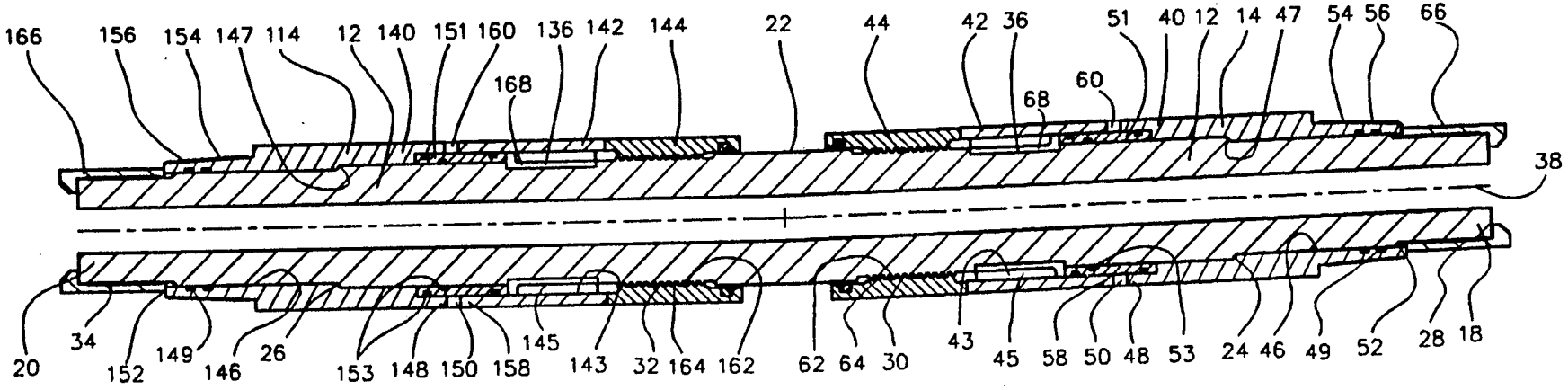
FIG. 4 is an alternate preferred embodiment of the invention.

Adjustable bent sub 10, as illustrated in FIG. 1, uses both second end nut 70 with axially extending teeth 78 and axially movable portion 42 with a splined engagement consisting of keys 68 and aligned keyways 36 and 45. However, a workable embodiment can be constructed which uses only one of those two described means as a rotational stop for sleeves 14 and 16. The Applicant prefers the two part sleeve with an axially movable portion 42 and a rotatable portion 40. The reason for this preference is that the engagement through keys 68 and aligned keyways 36 and 68 has increased strength and tends to be "fool proof" in adjustment. FIG. 4 illustrates a workable alternate embodiment utilizing a two part sleeve at both ends 18 and 20 of tubular member 12. In order to differentiate between adjustment sleeve 14 and the alternate orientation sleeve, the alternate orientation sleeve has been assigned reference numeral 114. Orientation sleeve 114 is identical to sleeve 14 with the exception that, being an orientation sleeve, it does not have an offset. The components are otherwise the same and the operation is the same. Briefly described those components are as follows. Alternate orientation sleeve 114 is divided into two portions; a rotatable portion 140 and an axially movable portion 142. Orientation sleeve 114 telescopically receives second end 20 of tubular member 12. Rotatable portion 140 has an internal bore 146, first end 148 and a second end 152 with axially extending teeth 150. Internal bore 146 has internal shoulders 147. O ring seals 149 are positioned in internal bore 146 at second end 152. Rotatable portion 140 has an external surface 154 which has threads 156 adjacent second end 152 whereby rotatable portion 140 is coupled to a tubular component of a drill string (not shown). Referring to FIG. 3, axially movable portion 142 has a first end 158 with axially extending teeth 160 for matingly engaging teeth 150 on rotatable portion 140. Axially movable portion 142 is axially movable along tubular member 12 between an engaged position wherein teeth 160 of axially movable portion 142 are engaged with teeth 150 of rotatable portion 140 and a disengaged position wherein axially movable portion 142 is disengaged from rotatable portion 140 such that rotatable portion 140 is freely rotatable. The engagement between rotatable portion 140 and axially movable portion 142 is sealed by a sealing ring 151 which has a plurality of O ring seals 153. Referring to FIG. 3, axially movable portion 142 has an interior surface 143 with longitudinal keyways 145. An adjustment lock nut 144 is axially movable along tubular member 12. Adjustment lock nut 144 has an internal surface 162 with threads 164. Adjustment lock nut 144 engages threaded zone 32 on exterior surface 22 of tubular member 12 to secure axially movable portion 142 in the engaged position. An alternate second end nut 166 is non-rotatably secured to threaded zone 34 at second end 20 of tubular member 12 thereby preventing separation of tubular member 12 and alternate orientation sleeve 114.

In the engaged position keyways 145 formed in interior surface 143 of axially movable portion 142 are aligned with keyways 136 formed in exterior surface 22 of tubular member 12. Keys 168 extend between aligned keyways 145 and 136 to non-rotatably couple axially movable portion 142 to tubular member 12.

It will be apparent to one skilled in the art that the use of an orientatable adjustable bent sub, as described, enables an adjustable bent sub to be oriented and yet does not add to the length of the drilling motor assembly. It will also be apparent to one skilled in the art that modifications may be made to the preferred embodiment without departing from the spirit and scope of the invention.

The embodiments of the invention in which an exclusive property or privilege is claimed are defined as follows:

1. An orientatable adjustable bent sub, comprising:

a. a tubular member having a first end, a second end, and an exterior surface, the tubular member having a primary axis, means being provided to offset the first end of the tubular member from the primary axis;

b. an adjustment sleeve having a first end and a second end, the second end of the adjustment sleeve telescopically receiving the first end of the tubular member, the adjustment sleeve having a primary axis, means being provided to offset the first end of the adjustment sleeve from the primary axis such that by rotation of the adjustment sleeve the offset portion of the adjustment sleeve is adjusted in relation to the offset portion of the tubular member to produce a bend of desired magnitude;

c. means to stop rotation of the adjustment sleeve in relation to the tubular member, the adjustment sleeve being axially moveable between an engaged position engaged with the rotational stop means and a disengaged position disengaged from the rotational stop means;

d. means to lock the adjustment sleeve in the engaged position;

e. an orientation sleeve having a first end and a second end, the first end of the orientation sleeve telescopically receiving the second end of the tubular member, the second end of the orientation sleeve being adapted for connection to a drill string such that by rotation of the tubular member within the orientation sleeve the bend created by the positioning of the offset portion of the adjustment sleeve in relation to the offset portion of the tubular member is orientated in a desired direction;

f. means to stop rotation of the orientation sleeve in relation to the tubular member, the orientation sleeve being axially moveable between an engaged position engaged with the rotational stop means and a disengaged position disengaged from the rotational stop means; and g. means to lock the orientation sleeve in the engaged position.

2. The orientatable bent sub as defined in claim 1, the means to lock one of the sleeves in position being a lock nut which engages a threaded zone on the exterior surface of the tubular member.

3. The orientatable bent sub as defined in claim 1, the rotational stop means for one of the sleeves being a plurality of splines engaging the sleeve and the tubular member.

4. The orientatable bent sub as defined in claim 2, the rotational stop means for one of the sleeves being engagement means on an end of one of the nuts which engages mating engagement means on one of the ends of the sleeve.

5. An orientatable adjustable bent sub, comprising:

a. a tubular member having a first end, a second end, and an exterior surface, the exterior surface having a plurality of annular threaded zones, the tubular member having a primary axis, means being provided to offset the first end of the tubular member from the primary axis;

b. an adjustment sleeve having a first end and a second end, the second end of the adjustment sleeve telescopically receiving the first end of the tubular member, the adjustment sleeve having a primary axis, means being provided to offset the first end of the adjustment sleeve from the primary axis such that by rotation of the adjustment sleeve the offset portion of the adjustment sleeve is adjusted in relation to the offset portion of the tubular member to produce a bend of desired magnitude; the adjustment sleeve being comprised of two portions connected by engagement means:

i. a rotatable portion at the first end of the adjustment sleeve, the rotatable portion being threaded whereby the adjustment sleeve is coupled to a tubular component of a drill string;

ii. an axially moveable portion at the second end of the adjustment sleeve, being axially moveable along the tubular member between an engaged position non-rotatably coupled to the tubular member by a plurality of splines and coupled with the rotational portion by the engagement means thereby preventing rotation of the rotatable portion of the adjustment sleeve, and a disengaged position disengaged from the splines and the engagement means whereby the rotatable portion of the adjustment sleeve is freely rotatable in relation to the tubular member;

c. an adjustment nut axially moveable along the tubular member, the adjustment nut having an internal surface with threads whereby the nut engages one of the threaded zones on the exterior surface of the tubular member to secure the axially movable portion adjustment sleeve in the engaged position;

d. a first end nut non-rotatably secured to one of the threaded zones at the first end of the tubular member thereby preventing separation of the tubular member and the adjustment sleeve;

e. a second end nut non-rotatably secured to one of the threaded zones at the second end of the tubular member, the second end nut having a first end and a second end, the first end having engagement means;

f. an orientation sleeve having a first end, a second end and an external surface, the first end of the orientation sleeve telescopically receiving the second end of the tubular member, the second end of the orientation sleeve having engagement means for matingly engaging the engagement means on the first end of the second end nut, the external surface at the second end of the orientation sleeve having threads whereby the orientation member is coupled to a tubular component of a drill string, the orientation sleeve being axially movable along the tubular member between an engaged position wherein the orientation member is engaged with the second end nut stopping rotation of the orientation member relative to the tubular member and a disengaged position wherein the orientation sleeve is disengaged from the second end nut and is freely rotatable, such that by rotation of the tubular member within the orientation sleeve the bend created by the positioning of the offset portion of the adjustment sleeve in relation to the offset portion of the tubular member is orientated in a desired direction; and g. an orientation lock nut axially movable along the tubular member, the orientation lock nut having an internal surface with threads whereby the orientation lock nut engages one of the threaded zones on the exterior surface of the tubular member to secure the orientation sleeve in the engaged position.

6. The orientatable adjustable bent sub as defined in claim 5, the engagement means being interengagable teeth.

7. An orientatable adjustable bent sub as defined in claim 5, the spline consisting of alignable keyways formed in an interior surface of the axially movable portion of the adjustment sleeve and the exterior surface of the tubular member, and keys extending between the aligned keyways.

8. An orientatable adjustable bent sub, comprising:

a. a tubular member having a first end, a second end, and an exterior surface, the exterior surface having a plurality of annular threaded zones, the tubular member having a primary axis, means being provided to offset the first end of the tubular member from the primary axis;

b. an adjustment sleeve having a first end and a second end, the second end of the adjustment sleeve telescopically receiving the first end of the tubular member, the adjustment sleeve having a primary axis, means being provided to offset the first end of the adjustment sleeve from the primary axis such that by rotation of the adjustment sleeve the offset portion of the adjustment sleeve is adjusted in relation to the offset portion of the tubular member to produce a bend of desired magnitude; the adjustment sleeve being comprised of two portions connected by engagement means:

i. a rotatable portion at the first end of the adjustment sleeve, the rotatable portion being threaded whereby the adjustment sleeve is coupled to a tubular component of a drill string;

ii. an axially moveable portion at the second end of the adjustment sleeve, being axially movable along the tubular member between an engaged position non-rotatably coupled to the tubular member by a plurality of splines and coupled with the rotational portion by the engagement means thereby preventing rotation of the rotatable portion of the adjustment sleeve, and a disengaged position disengaged from the splines and the engagement means whereby the rotatable portion of the adjustment sleeve is freely rotatable in relation to the tubular member;

c. an adjustment lock nut axially movable along the tubular member, the adjustment lock nut having an internal surface with threads whereby the lock nut engages one of the threaded zones on the exterior surface of the tubular member to secure the axially movable portion adjustment sleeve in the engaged position;

d. a first end nut-rotatably secured to one of the threaded zones at the first end of the tubular member thereby preventing separation of the tubular member and the adjustment sleeve;

e. an orientation sleeve having a first end, a second end and an external surface, the first end of the orientation sleeve telescopically receiving the second end of the tubular member, the orientation sleeve being comprised of two portions connected by engagement means:

i. a rotatable portion at the second end of the orientation sleeve, the rotatable portion being threaded whereby the orientation sleeve is coupled to a tubular component of a drill string;

ii. an axially moveable portion at the first end of the orientation sleeve, being axially moveable along the tubular member between an engaged position non-rotatably coupled to the tubular member by a plurality of splines and coupled with the rotational portion by the engagement means thereby preventing rotation of the rotatable portion of the orientation sleeve, and a disengaged position disengaged from the splines and the engagement means whereby the rotatable portion of the orientation sleeve is freely rotatable in relation to the tubular member, such that by rotation of the tubular member within the orientation sleeve the bend created by the positioning of the offset portion of the adjustment sleeve in relation to the offset portion of the tubular member is orientated in a desired direction;

f. an orientation lock nut axially movable along the tubular member, the orientation lock nut having an internal surface with threads whereby the orientation lock nut engages one of the threaded zones on the exterior surface of the tubular member to secure the orientation sleeve in the engaged position; and g. a second end nut non-rotatably secured to one of the threaded zones at the second end of the tubular member, thereby preventing separation of the tubular member and the orientation sleeve.

* * * * *